US005141054A

United States Patent [19]

Alameddine et al.

[11] Patent Number: 5,141,054

[45] Date of Patent: Aug. 25, 1992

[54] LIMITED ENTRY STEAM HEATING METHOD FOR UNIFORM HEAT DISTRIBUTION

[75] Inventors: Bassem R. Alameddine, Carrollton; Dimitri T. Hatziavramidis, Plano, both of Tex.

[73] Assignee: Mobil Oil Corporation, Fairfax, Va.

[21] Appl. No.: 668,836

[22] Filed: Mar. 13, 1991

[51] Int. Cl.[5] ..... E21B 43/24; E21B 49/00

[52] U.S. Cl. ..... 166/252; 166/50; 166/297; 166/303

[58] Field of Search ..... 166/250, 252, 269, 272, 166/303, 297, 298, 50

[56] References Cited

U.S. PATENT DOCUMENTS

| | | | |
|---|---|---|---|
| 3,960,213 | 6/1976 | Striegler | 166/50 X |
| 4,160,481 | 7/1979 | Turk et al. | 166/50 X |
| 4,640,355 | 2/1987 | Hong et al. | 166/269 |
| 4,648,455 | 3/1987 | Luke | 166/269 X |
| 4,653,583 | 3/1987 | Huang et al. | 166/252 |
| 4,702,314 | 10/1987 | Huang et al. | 166/50 X |
| 4,770,244 | 9/1988 | Webb | 166/269 X |

*Primary Examiner*—George A. Suchfield
*Attorney, Agent, or Firm*—A. J. McKillop; C. J. Speciale; C. A. Malone

[57] ABSTRACT

A well completion method is claimed for steam stimulation of a wellbore, either horizontal or vertical, where limited entry perforations are utilized. Limited-entry perforations of specified spacing and size are placed into a closed-end injection tubing. Steam is directed down the tubing and distributed through the perforations which act as steam chokes, under critical flow conditions, thereby causing uniform steam injection and uniform heating along a desired length of a horizontal wellbore.

9 Claims, 3 Drawing Sheets

LIMITED ENTRY STEAM HEATING METHOD FOR UNIFORM HEAT DISTRIBUTION

FIELD OF THE INVENTION

This invention is directed to a method for the recovery of viscous hydrocarbonaceous fluids from a formation. More specifically, it is directed to the removal of said fluids from a formation containing heavy viscous hydrocarbons or tar sands by the controlled entry of steam into a reservoir via a horizontal wellbore. Steam is distributed uniformly by limited-entry perforations which act as chokes operating under critical flow conditions.

BACKGROUND OF THE INVENTION

The use of horizontal wells in oil reservoirs is currently of high interest within the oil industry. Horizontal wells allow more reservoir surface area to be contacted and thereby reduce inflow pressure gradients for reasonable oil production rates. Alternatively, for typical pressure gradients within the wellbore region, the productivity of a horizontal well is greater than that in a vertical well.

Possible benefits of horizontal wells are currently being exploited in the Canadian tar sands. Reservoirs in Canada that may be categorized as immobile under reservoir conditions include the Cold Lake and Athabasca deposits.

Current practices for producing immobile tar sands include mining and steam stimulation by formation fracturing. However, mining is not practical below very shallow depths. Furthermore, steam stimulation by formation fracturing is not feasible in those reservoirs underlain by water aquifers and/or developed by closely spaced vertical wells.

Steam stimulation below fracture pressure in a vertical well is not practical due to very low injectivity of the formation to steam and to the very small area of reservoir contact. Increased area of contact can be achieved by the use of long horizontal wells (1,000 to 3,000 feet as compared to 30 to 100 feet for a vertical well). This increased contact allows more of the reservoir's area to be heated by steam injection. This results in more oil production due to an increased volume of the heated zone. Unfortunately, for the immobile tar sands, even when heated, injectivity may remain very low. Injection of a large steam slug into a horizontal well underlain by a water aquifer may result in a fracture into the aquifer.

Horizontal wells are typically used to condition a formation in one of two ways. One way is to circulate steam into the wellbore in order to heat up the wellbore and reservoir therearound. Two types of countercurrent steam circulation methods are generally used. In one method, steam is injected into a casing annulus and fluids are circulated back and produced to through the tubing the surface. In another method, steam is injected inside the production tubing and fluids are circulated back through the casing annulus. Although countercurrent steam circulation improves some of the heat transfer between the casing and reservoir, it lacks the capability of ensuring uniform distribution of heat along the entire length of a completed horizontal wellbore.

Another way of conditioning a formation is by steam injection. Steam injection is either through the casing side or through the tubing. However, unlike steam circulation, no fluids are produced back. Also, all of the injection steam enters the reservoir. Regardless of the steam injection method, steam and heat may not be distributed uniformly into the reservoir. The resulting uneven heating of the formation inhibits utilization of the entire horizontal section for production purposes.

Therefore, what is needed is a method for steam circulation or steam injection into a wellbore which ensures uniform distribution of steam and heat throughout the entire length of a wellbore into a reservoir or formation.

SUMMARY OF THE INVENTION

This invention is directed to a limited-entry perforation method for uniformally distributing steam and heat through a horizontal wellbore into a subterranean formation. Initially, a horizontal well length is determined to obtain the most effective and efficient recovery of viscous hydrocarbonaceous fluids from a formation. Thereafter, a wellbore is drilled through the formation in order to achieve the determined length. Next, a steam injection rate and volume are determined to heat the formation at a desired distance away from the wellbore and to cause a decrease in viscosity of the hydrocarbonaceous fluids within the formation. The decrease in viscosity facilitates flow of these fluids towards the wellbore.

Steam is circulated or injected after comparing the desired wellbore pressure to the reservoir pressure (steam is injected, if wellbore pressure exceeds the reservoir pressure; steam is circulated, if wellbore pressure is smaller than the reservoir pressure). In both cases, steam is supplied through a closed-end tubing which extends over the entire length of the horizontal well. The tubing contains a number of perforations of controlled size which act as chokes operating under critical flow conditions.

Critical flow occurs when the steam velocity in the tubing reaches acoustic speed. While in subsonic flow, the mass flow rate depends on the difference of injection and discharge pressures, in critical flow it depends only on injection pressure, Below a certain value of discharge pressure, the mass flow rate becomes constant independent of any decrease in the injection pressure. Pressure, temperature, steam quality and phase (vapor or liquid) velocities are determined from a system of differential equations describing mass, momentum and energy balance for one-dimensional, two-phase steam flow (vapor and liquid phases can be treated separately or as a mixture with or without the assumption of thermodynamic equilibrium). Singular values of these variables at critical flow result, if the determinant of the matrix coefficient in the above system vanishes and the appropriate compatibility condition applies. Singular values of state and flow variables are expressed in terms of their stagnation values at tubing inlet.

It is therefore an object of this invention to insure a uniform distribution of steam and heat throughout the entire length of a wellbore via controlled steam distribution by a closed-end tubing.

It is another object of this invention to use controlled steam entry so as to inject steam and heat to effectively drain a reservoir, even those having a low permeability.

It is yet another object of this invention to provide for a controlled steam entry method which can be used with varying steam injection rates, steam qualities, and steam injection pressures.

It is even yet another object of this invention to provide for a controlled steam entry method which can be used with different wellbore mechanical configurations and with different placement of perforations along the tubing.

It is a still yet further object of this invention to provide for a controlled steam entry method which can be used in an open hole, a slotted liner, or cemented casing.

DESCRIPTION OF THE PREFERRED EMBODIMENTS

Figure 1A:
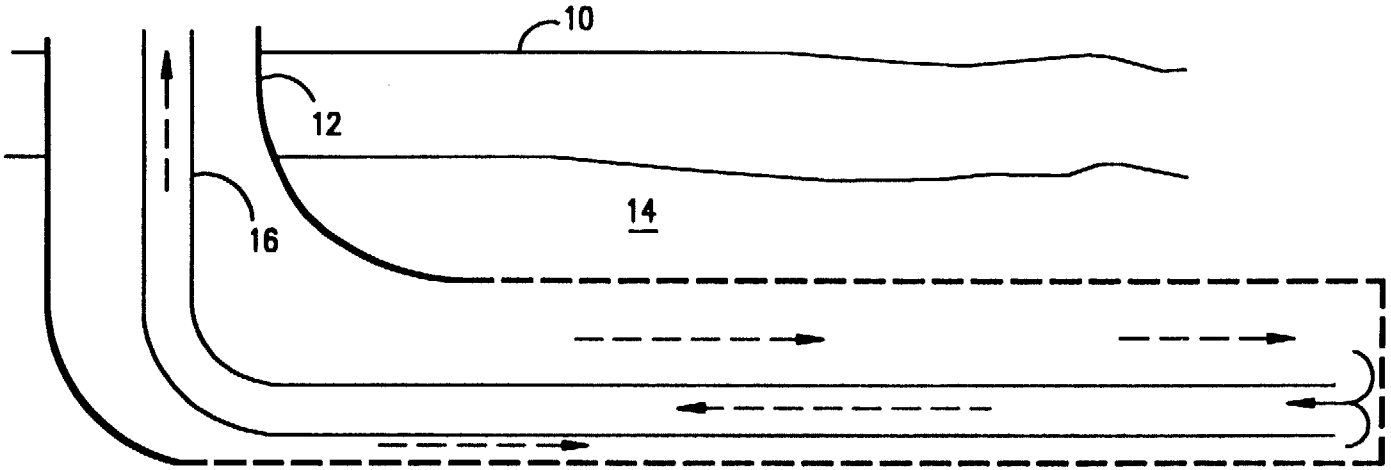
FIG. 1A (PRIOR ART)
FIG. 1A is a schematic representation of a horizontal wellbore within the completed interval of a formation showing steam supply through the annulus and removal of produced fluids to the surface by the tubing.
Figure 1B:
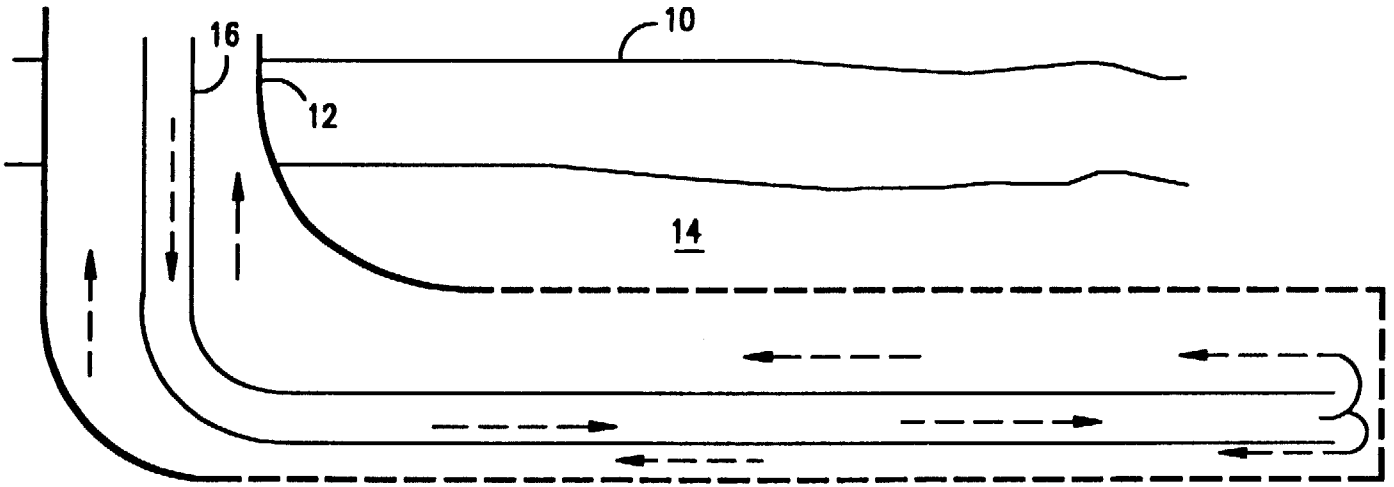
FIG. 1B (PRIOR ART)
FIG. 1B is a schematic representation of a horizontal wellbore within a completed interval of a formation showing countercurrent steam supply through the tubing and removal of hydrocarbonaceous fluids by the annulus.

As is shown in FIGS. 1A and 1B, two types of steam circulation into the horizontal well are generally used. As is shown in FIG. 1A, wellbore 12 has penetrated formation 10. The horizontal portion of wellbore 12 enters the productive interval 14 of the formation 10. Steam is supplied through the annulus which is formed between tubing 16 and wellbore 12. Fluids produced from the formation enter the wellbore through perforations in the casing or through a slotted liner. Once in wellbore 12, produced fluids are lifted to the surface via tubing 16.

Another method of steam circulation is shown in FIG. 1B. Here, steam is supplied into wellbore 12 via tubing 16. Heat enters the formation through the perforated casing or the slotted liner. Any unused steam is removed from wellbore 12 via the annulus formed between wellbore 12 and tubing 16.

FIGS. 1A and 1B show steam circulation. However, if the return-to-the-surface of injected steam and produced fluids is blocked, the configurations depicted in the above Figures also apply to steam injection into the formation.

Figure 3:
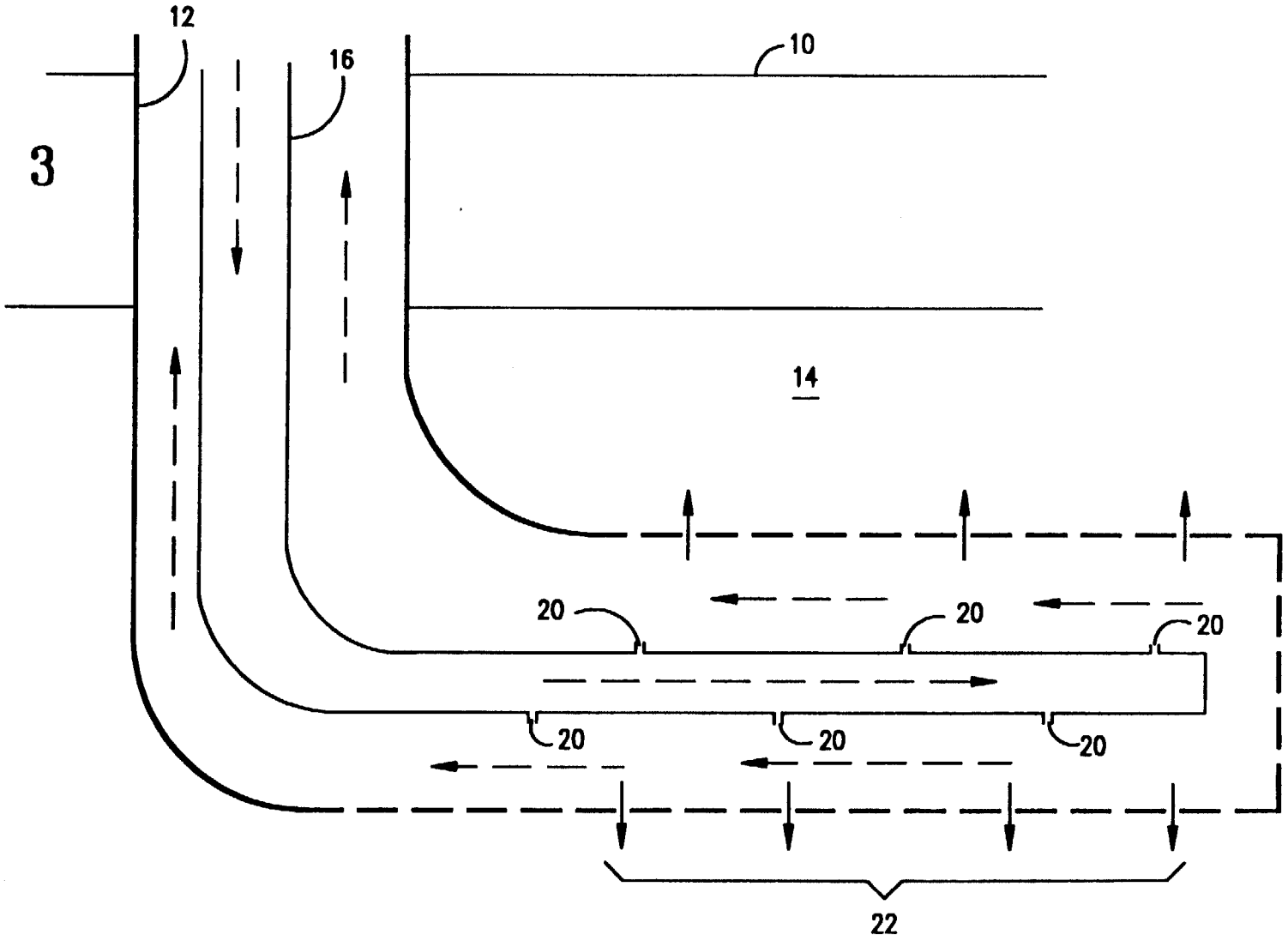
FIG. 3 is a schematic representation of a horizontal wellbore where the limited-entry perforation technique is used to inject steam through the tubing into the formation via a perforated casing or a slotted liner.

In the practice of this invention, referring to FIG. 3, a wellbore length is determined to obtain the most effective and efficient recovery of hydrocarbonaceous fluids from a formation. The volume of steam which will be required to heat productive interval 14 at a desired distance away from wellbore 12 is also determined so as to be sufficient to cause a decrease in the viscosity of hydrocarbonaceous fluids within the productive interval, thereby moving said fluids toward wellbore 12 from productive interval 14. Wellbore 12 can include an open hole, a slotted liner, or a cemented casing.

Prior to commencing steam injection into wellbore 12, the heat transfer characteristics of productive interval 14 along the determined distance of the wellbore are ascertained so as to obtain the most effective and efficient manner of removing viscous hydrocarbonaceous fluids from said interval. Although the wellbore depicted in FIG. 3 is horizontal, a vertical as well as a slanted wellbore can be used where necessary. A time for injecting steam into productive interval 14 to heat it to a desired temperature required is also determined. The desired temperature will be sufficient to cause a reduction in viscosity of hydrocarbonaceous fluids and facilitate the movement of these fluids into wellbore 12 at a desired distance along perforated casing 22 or slotted liner 22.

Having determined (1) the volume of steam required to heat the interval a desired distance away from wellbore 12; (2) the heat transfer characteristics of the productive interval 14 along wellbore 12; and (3) the time for injecting the required volume of steam into the formation, the number, size and spacing of perforations along tubing 16 are ascertained to achieve critical flow conditions. Steam is injected via tubing 16 through perforations 20 therein so as to enter the annulus formed by tubing 16 and slotted liner or perforated casing 22. Critical flow conditions prevail in the supply of steam through perforations 20 so as to distribute uniformly steam and heat through perforated casing 22 or slotted liner into the productive interval 14 (uniform steam distribution to the formation is ensured, if steam is injected; uniform heat distribution to the formation is ensured, if steam is circulated).

Figure 2:
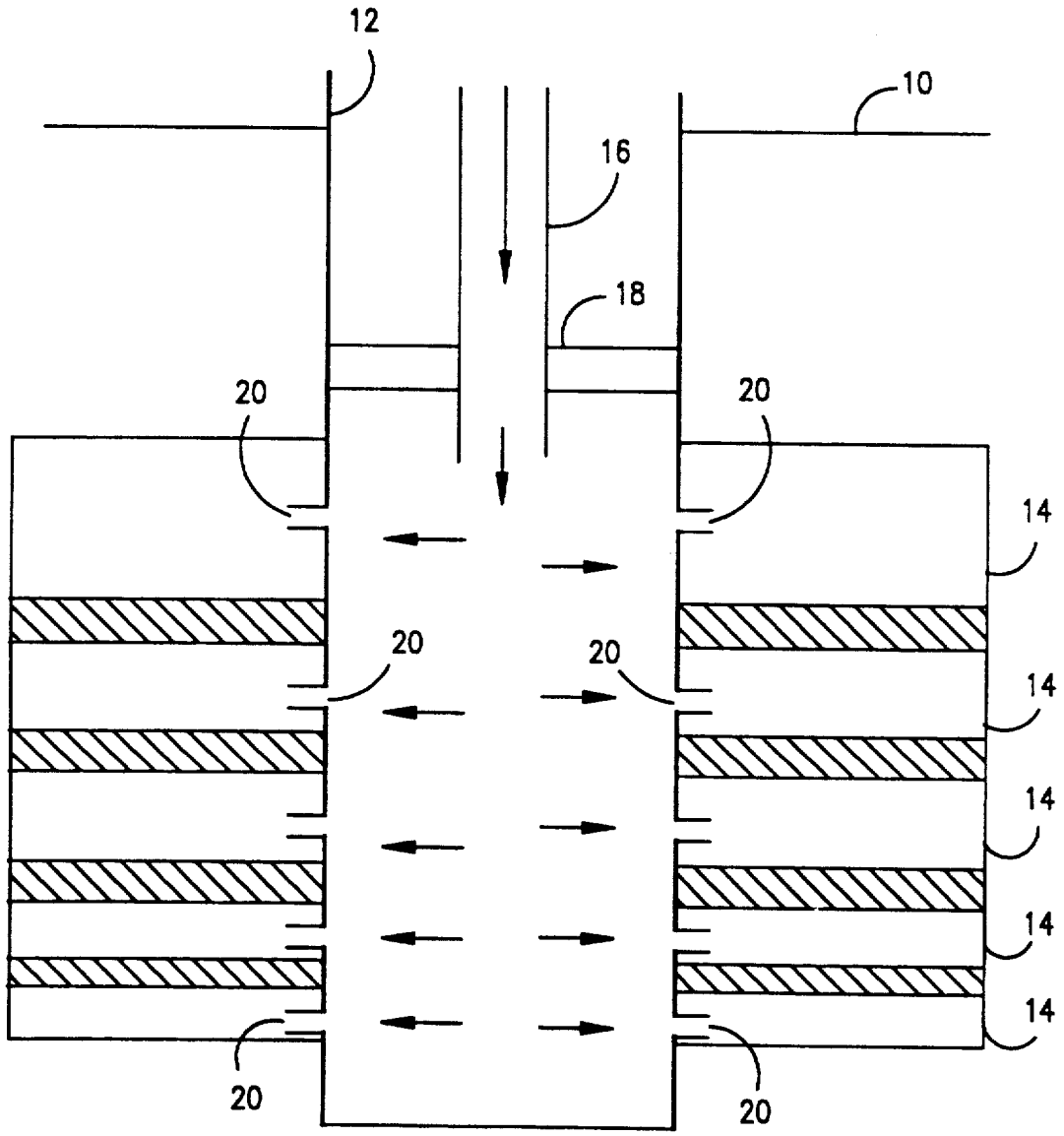
FIG. 2 is a schematic representation of the vertical wellbore where the limited-entry perforation technique is used to inject steam through the casing into several productive zones of a formation.

Referring to FIG. 2, similar considerations are given to this embodiment for determining conditions for critical steam flow through perforations in multiple productive intervals 14 of formation 10. In order to obtain steam entry into productive interval 14, tubing 16 is passed through packer 18 which communicates with wellbore 12. Perforations 20 are made through wellbore 12 so as to communicate with productive intervals 14. Steam is directed through tubing 16 at a critical velocity so as to proceed through perforations 20 and obtain uniform steam distribution into the productive intervals 14. When the desired volume of steam has been introduced into each productive interval 14 via perforations 20 for the desired time period, the productive interval 14 is heated a desired distance from wellbore 12 so as to cause hydrocarbonaceous fluids to move from the productive interval into wellbore 12 for production to the surface. Productive interval 14 is comprised of viscous hydrocarbonaceous fluids which include tar sands and asphaltic materials.

As mentioned above relative to FIGS. 1A and 1B, tubing 16 or an annulus formed by tubing 16 and wellbore 12 can be used to inject steam into the formation. Depending on which configuration is used, either the casing is perforated or tubing 16 is perforated so as to obtain perforations necessary for limited steam entry. Either tubing 16 or the casing is perforated so as to provide a plurality of perforations at the determined distance along wellbore 12. As expected, these perforations are spaced between about 10 to about 100 feet apart so the desired volume of steam can be injected at a critical velocity through the perforations. Such perforations may comprise two sets which are simultaneously formed on opposite sides of tubing 16 or perforated casing 22. A set can be one or more perforations. Preferably, these perforations should have diameters between about one-fourth and about one-half of an inch and should be placed circumferentially about tubing 16 or perforated casing 22 along the desired distance to obtain the most efficient and effective removal of hydrocarbonaceous fluids from the wellbore. Other perforating techniques that will achieve limited steam entry conditions may be employed as will be apparent to those skilled in the art.

Although the present invention has been described with preferred embodiments, it is to be understood that modifications and variations may be resorted to without departing from the spirit and scope of this invention, as those skilled in the art would readily understand. Such variations and modifications are considered part of this invention and within the purview and scope of the appended claims.

What is claimed is:

1. A limited-entry method for uniformly distributing steam and heat through a horizontal wellbore into a subterranean formation comprising:

a) determining a horizontal wellbore length required to obtain the most effective and efficient recovery of viscous hydrocarbonaceous fluids from said formation;

b) drilling a horizontal wellbore and providing therein a perforated casing or a slotted liner so as to achieve a determined length to obtain the most effective and efficient recovery of viscous hydrocarbonaceous fluids from the formation;

c) ascertaining a volume of steam required to heat the formation at a desired distance away from the wellbore so as to cause viscous hydrocarbonaceous fluids within the formation to decrease in viscosity and move towards the wellbore;

d) determining the heat transfer characteristics of the formation along the wellbore at the distance determined to be most effective and efficient for recovering viscous hydrocarbonaceous fluids from the formation;

e) determining a time for injecting the required volume of steam into the formation to heat the formation to a temperature required to cause viscous hydrocarbonaceous fluids to become reduced in viscosity so as to move into the wellbore at the desired distance;

f) using data obtained from steps a) through e) to decide number, size and spacing of perforations which are placed along a determined wellbore length of closed ended tubing that is located within the horizontal wellbore to achieve critical flow conditions so as to distribute uniformly steam and heat to the formation via said perforations; and g) injecting steam through perforations in said tubing under critical flow conditions thereby obtaining uniform steam and heat entry into the formation via said horizontal wellbore.

2. The method as recited in claim 1 where said viscous hydrocarbons comprise tar sands or asphaltic materials.

3. The method as recited in claim where after step a hydrocarbonaceous fluids are removed from the formation.

4. The method as recited in claim 1 where in step f) said perforations are spaced between about 10 to about 100 feet apart.

5. The method as recited in claim 1 where in step f) two sets of perforations are simultaneously formed on opposite sides of the tubing.

6. The method as recited in claim 1 wherein in step f) said perforations have diameters between about one-fourth to about one-half of an inch and are placed circumferentially about the tubing within said wellbore.

7. The method as recited in claim 1 where in step f) said perforations have diameters between about one-fourth to about one-half of an inch and are placed circumferentially about said tube.

8. The method as recited in claim 1 where a productive interval of the formation contains tar sands or asphaltic materials.

9. The method as recited in claim 1 where after step g) hydrocarbonaceous fluids of reduced viscosity are removed from the formation.

* * * * *